US005154305A

United States Patent [19]

Whitney

[11] Patent Number: 5,154,305

[45] Date of Patent: Oct. 13, 1992

[54] VERTICALLY-SLIDEABLY MOUNTED STORAGE RACK SYSTEM

[76] Inventor: Alan R. Whitney, 165 Miller Rd., Avon Lake, Ohio 44012

[21] Appl. No.: 707,824

[22] Filed: May 30, 1991

Related U.S. Application Data

[63] Continuation of Ser. No. 101,836, Sep. 28, 1987, abandoned.

[51] Int. Cl.[5] ..... A47F 5/00

[52] U.S. Cl. ..... 211/162; 211/94.5

[58] Field of Search ..... 211/46, 162, 94, 94.5; 312/342, 345, DIG. 33

[56] References Cited

U.S. PATENT DOCUMENTS

| | | | |
|---|---|---|---|
| 2,608,305 | 8/1952 | Sager | 211/162 X |
| 2,660,506 | 11/1953 | Wright | 312/345 X |
| 2,923,584 | 9/1955 | Broderick, Jr. | 312/317 |
| 3,185,309 | 5/1965 | Radek | 211/94 X |
| 3,190,712 | 6/1965 | Fielden | 312/311 |
| 3,664,719 | 5/1972 | Berg | 312/DIG. 33 |
| 4,140,225 | 2/1979 | Hilgers et al. | 211/162 |
| 4,585,127 | 4/1956 | Benedict | 211/94 X |
| 4,854,656 | 8/1989 | O'Keefe | 312/345 |

*Primary Examiner*—Robert W. Gibson, Jr.
*Attorney, Agent, or Firm*—Gustalo Nunez

[57] ABSTRACT

A plurality of parallel storage mounting panels slideably disposed with respect to each other. Said mounting panels being perpendicular with respect to a floor surface, yet not being connected to said floor surface. Further, said storage mounting panels are capable of storing items such as bottles, tools, cassette tapes and other miscellaneous items. When not in use, said storage mounting racks being in a side-by-side relationship, thereby occupying a minimum amount of space where the storage racks are utilized. The storage mounting panels are provided with bearing means which are connected to support means, the support means being of a design capable of accepting a plurality of slideably mounted storage panels. The bottom terminating ends of the storage mounting panels are free swinging with respect to the floor, swinging in a direction generally perpendicular to the support means.

1 Claim, 6 Drawing Sheets

VERTICALLY-SLIDEABLY MOUNTED STORAGE RACK SYSTEM

This application is a continuation of co-pending U.S. application Ser. No. 07/101,836, filed Sept. 28, 1987, now abandoned.

The present invention is directed to a storage system for use in the house, warehouse or factory; indeed, wherever storage space is at a premium, especially the workshop. The storage system contemplate here allows the storage of a multiplicity of items, materials and objects and, if additional storage is required, the storage system can be easily increased. The storage system incorporates a plurality of vertically disposed panels which are slideably mounted to a support member. The panels are adjacent to each other as well as being in close proximity to each other, thus saving space. The panels are provided with guide means and rollers for easy movement when in use. Each individual panel can be utilized to store a variety of items such as jars, tools, cassette tapes, brooms, mops, etc.; the uses are unlimited. The bottom edges of each individual panel is free swinging in a direction generally perpendicular to said guide means thus enabling a user of said panel to gain access to those items stored on said panels simply by moving the panels in a direction opposite to another adjacent panel.

One such type of storage system is described in U.S. Pat. No. 2,922,584 which relates to storage cabinets. The invention provides a cabinet which includes a plurality of cabinets stacked in a horizontal relationship with respect to each other. The invention utilizes guide and bearing means both on the tops and bottoms of the cabinets in order to obtain a firm support of the drawers in any position of withdrawal of the drawers from the cabinet. Further, a plurality of tracks are included, each disposed below a different drawer. The tracks are attached at one end to the cabinet frame and are bent at an intermediate position for slideable movement in a vertical direction at a position near the front of the drawers. A study of the above invention reveals a storage system which does conserve on space, but which is mechanically complex in construction.

SUMMARY OF THE INVENTION

Therefore, with the foregoing in mind, it is a primary object of the present invention to provide a new and improved modular system for a vertically disposed storage system, in which the storage racks are mounted adjacent to each other and in which the storage racks are slideably disposed with respect to each other and that are also free swinging with respect to each other. Further, the storage system contemplated by this invention does not require a floor support member.

The storage system contemplated here can be fabricated by using one support member; it has been found that the storage system is much more stable using at least two support members attached to a surface member such as a ceiling. Attached to the support members is at least one elongated channel member including a track adapted to receive some type of bearing means. The storage panels are connected to the bearing means by conventional bolting methods. The panel members may be provided with holes, hooks, shelves, all dependent on what is to be stored. The panels are mounted adjacent to each other in close proximity to each other with the purpose of conserving space. The panels are provided with hidden handle means for withdrawing a panel from the adjacent panel members.

BRIEF DESCRIPTION OF THE DRAWINGS

The storage system contemplated herein will be better understood and objects other than those set forth above will become apparent when consideration is given to the following detailed description. Such description makes reference to the annexed drawings wherein, throughout the various figures, there have been used the same reference numerals to denote the same components and wherein.

DETAILED DESCRIPTION OF THE PREFERRED EMBODIMENT

Figure 1:
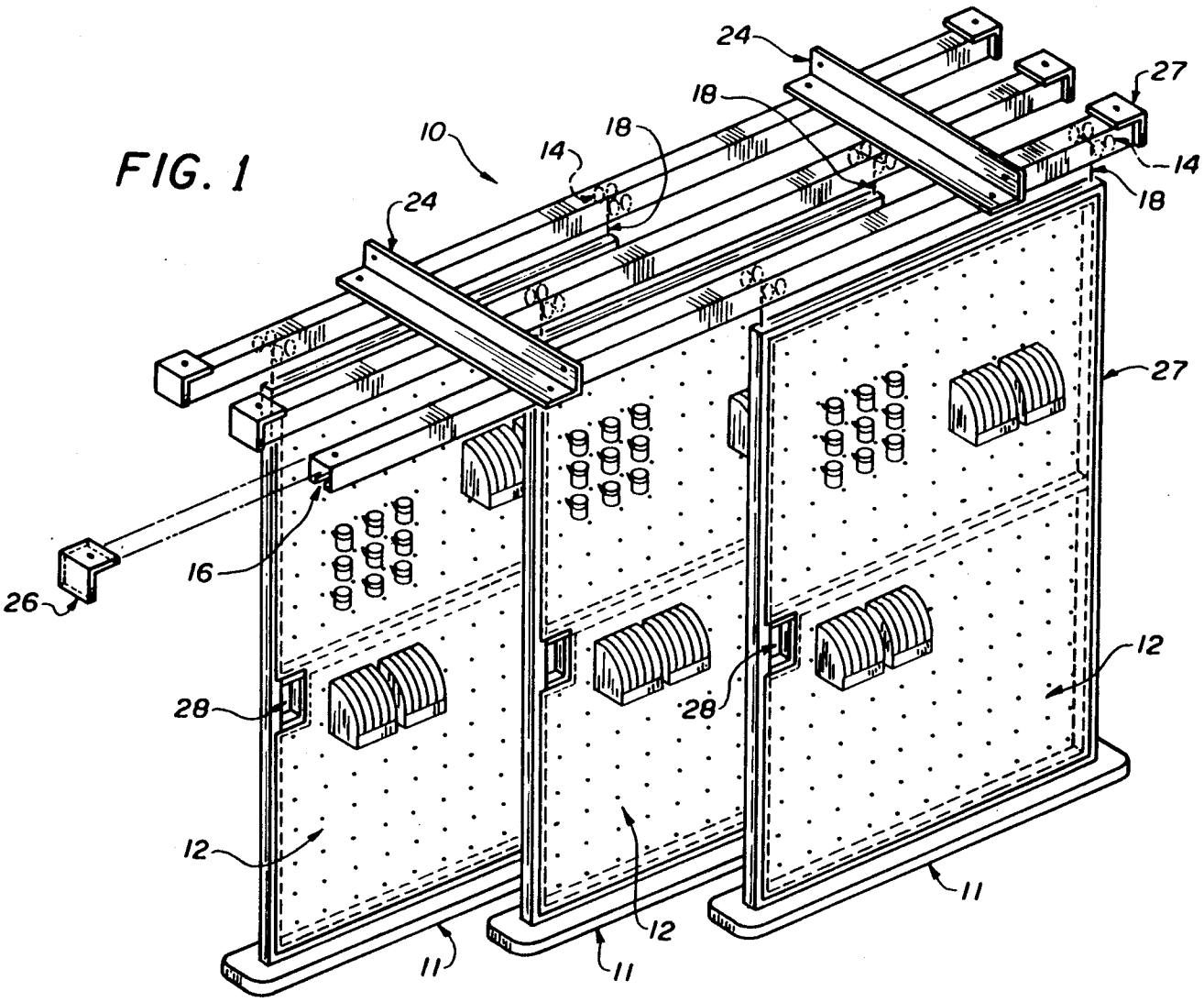
FIG. 1 is a perspective view of the vertically disposed storage system formed of a plurality of slideably mounted panels.

Describing now the preferred embodiment of the invention, it is to be understood that only enough of the construction of the modular storage system has been shown as needed to enable one skilled in the art to readily understand concepts of the present invention. Referring now to FIG. 1, there is illustrated a perspective view of the present modular storage system and referred to with the designation 10. FIG. 1 illustrates three storage modules 12 which are generally identical to each other, the only difference being what is stored on the modules. The storage modules 12 used herein are flat rectangular boards which are provided with means for retaining jars, racks and the like. Of course, the storage modules can take on other configurations, e.g. a plurality of drawers, without departing from the scope of this invention. Each storage module 12 is provided with bearing means 14 in which the bearing means 14 may be conventional stamped steel wheels 15 and 17 designed to be used with metal frame doors, steel gates and the like; in this instance, the bearing means are accommodated within a channel formed in a track bracket 16. The track bracket 16 is a rectangular elongated channel being open on one side, see FIG. 2. This open side accommodates a hanging member 18. The open end of track bracket further defines a pair of tracks 20 and 22 which slideably receive the wheels 15 and 17 of the bearing member 14. The hanging member 18 and the bearing means 14, when assembled, are one integral unit.

FIG. 1 illustrates three storage modules 12 which are each slideably connected to a respective track bracket 16. All of the track bracket members 16 are vertically supported by support members 24, which in this instance are conventional steel hangers. The support members 24 are connected by conventional means such as screws to a ceiling surface. Each bracket 16 is provided with a stop member 26 and 28, at each terminating end, which prevents the slideably mounted storage module 12 from leaving the track bracket 16.

The storage module 12 can be used to store a multiplicity of items such as tools, pots, pans, bottles, brooms, and the like. The number of items and/or objects which may be stored are virtually unlimited simply by adding additional storage modules. The storage device 10, when not being used, utilizes a minimum amount of space as compared to the number of items which can be stored within. The storage modules 12 are provided with a suitable frame 27 for extra strength. The storage modules are also, for ease in using, provided with handles 28 which are not visible when the storage device 10 is not in use. The storage modules 12 may have a plurality of holes thereon for retaining hooks; this could be comprised of conventional pegboard. Each storage module 12 is terminated at the bottom end with an elongated platform 11 which functions to maintain a certain space relationship between the storage modules 12.

Figure 3:
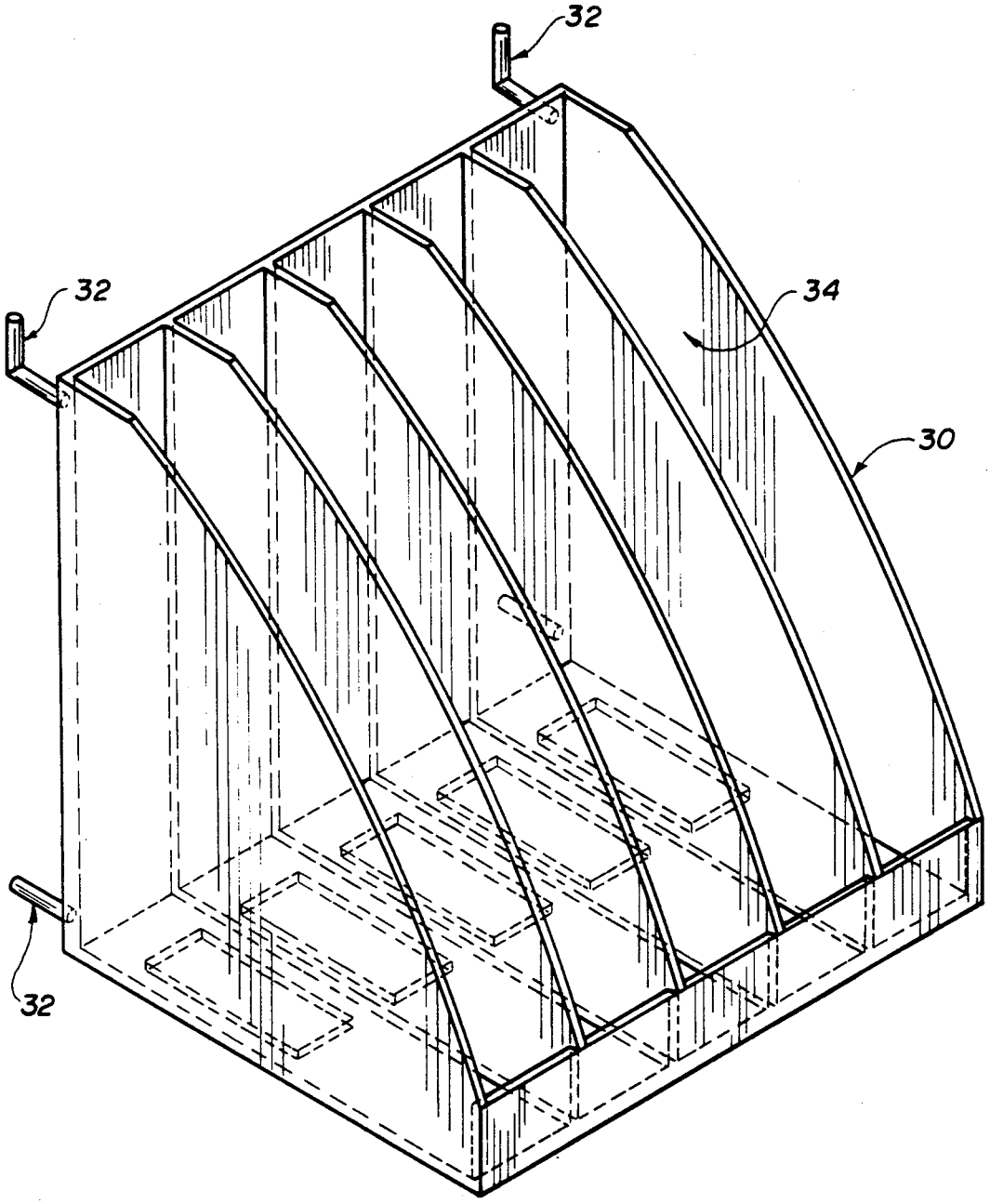
FIG. 3 is a perspective view, partly in cross-section of one type of storage component which may be used with the storage system.

FIG. 3 illustrates one example of a storage means which may be used with the storage device 10. It is ia rack 30 equipped with hooks 32 for use with the storage module 12. The storage means 30 contains a plurality of openings 34 which, for example, may be used to store video cassettes.

In use, the user would only need to grasp the handle 28, pull out the selected storage module 12 and select the desired item, and return the storage module to its not-in-use position. The storage module 10 described herein is not supported by the floor, which facilitates keeping the floor area clean.

Figure 4:
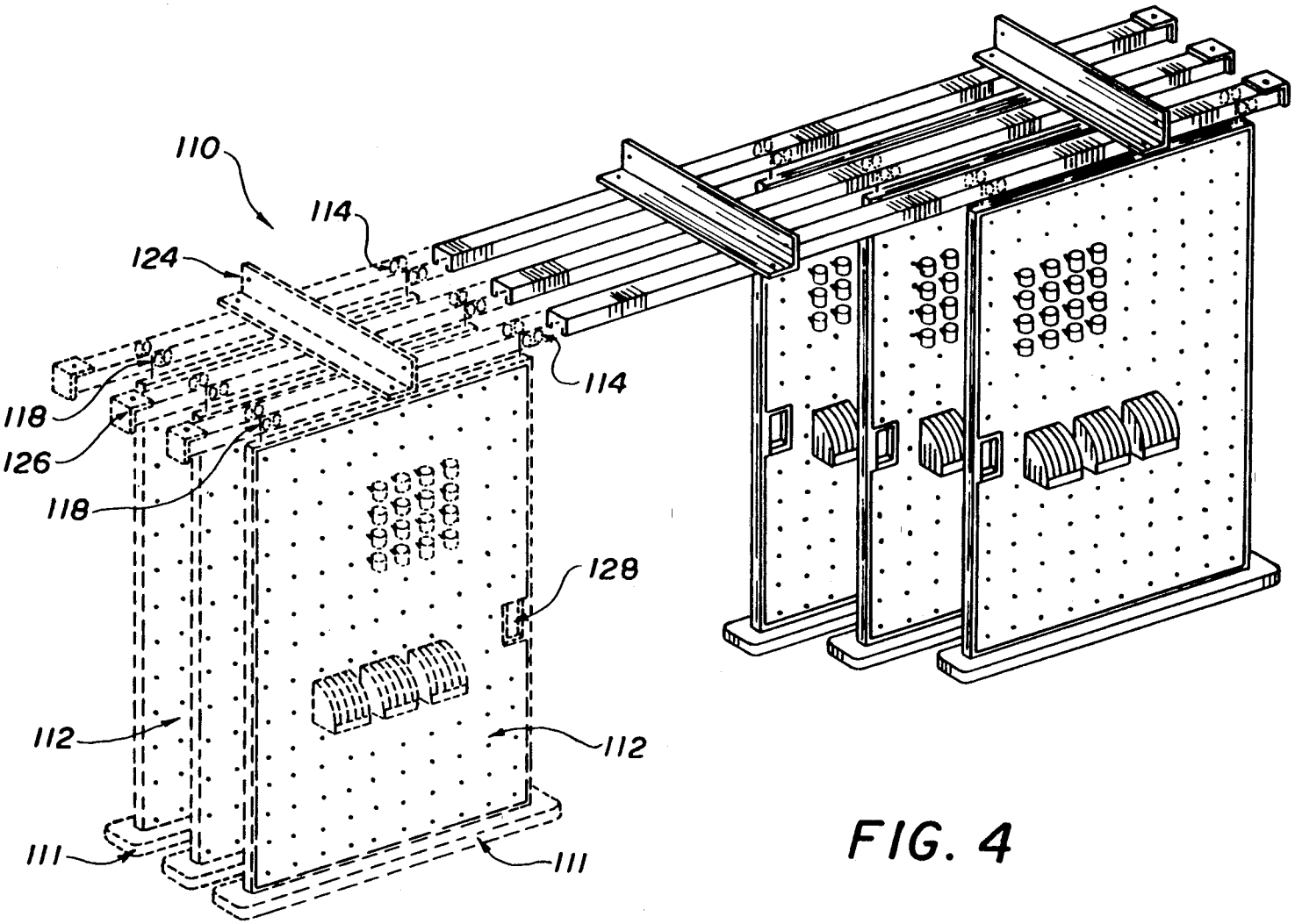
FIG. 4 is a perspective view of a second embodiment of the invention illustrating a plurality of storage panels slideably mounted on the same track.

FIG. 4, a second embodiment of the invention, illustrates a modular storage system 110. Further, shown in FIG. 4 are three storage modules 112, each of which is generally identical to each other. The storage modules 112 are similar to those shown in the first embodiment of this invention. Each storage module 112 is provided with bearing means 114; for clarity in the drawings, not all the bearing members 114 are numbered, although they are all identical. The bearing members 114 are accommodated within a channel formed in the track bracket 116, similar to the track bracket 16, FIG. 1. The track bracket 116 is a rectangular elongated channel open on one side, said opening accommodating a hanging member 118. FIG. 4 further illustrates six storage modules 112 of which two storage panels 112 are mounted on the same track bracket 116. This embodiment permits storage modules 112 to rest on each end of the brackets 116, thereby leaving on aisleway between the storage modules 112 and thus allowing increased storage in a small area while having enough room in the aisleway for a person to walk through. All of the track bracket members 116 are supported by support member 124 which, in this embodiment, are conventional steel hangers. The support members 124 may be secured to an elevated surface member, such as a ceiling, by conventional connecting means such as screws. Each bracket is provided with a stop member 126 and 128 at each terminating end which prevent slideably mounted storage modules 112 from becoming separated from the bracket 116.

Figure 5:
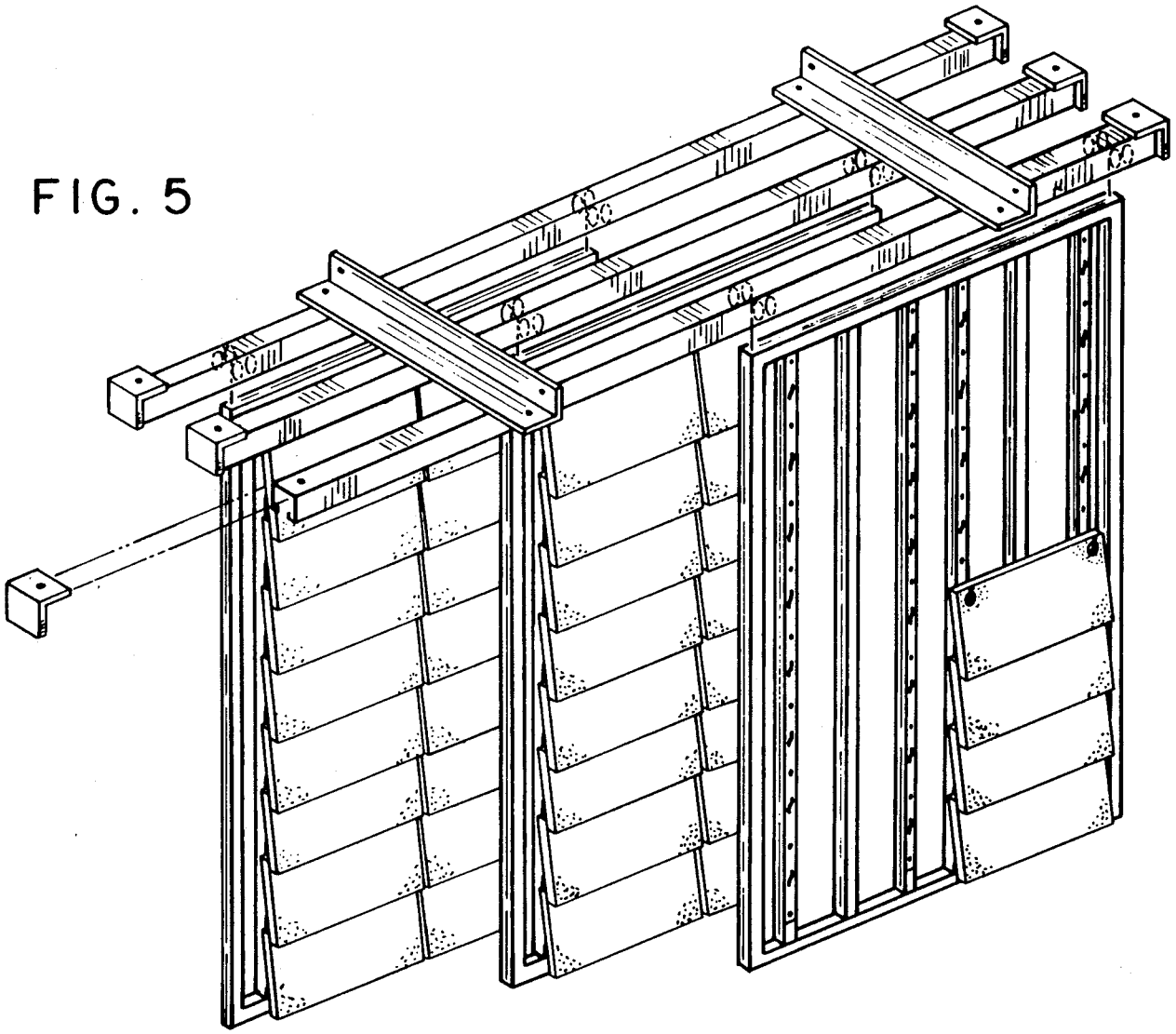
FIG. 5 is yet another perspective view of the vertically disposed storage system illustrating yet another storage use.
Figure 6:
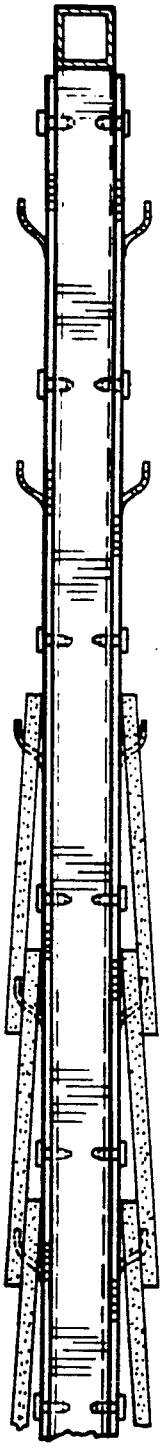
FIG. 6 is a side view of the vertically disposed storage system.
Figure 7:
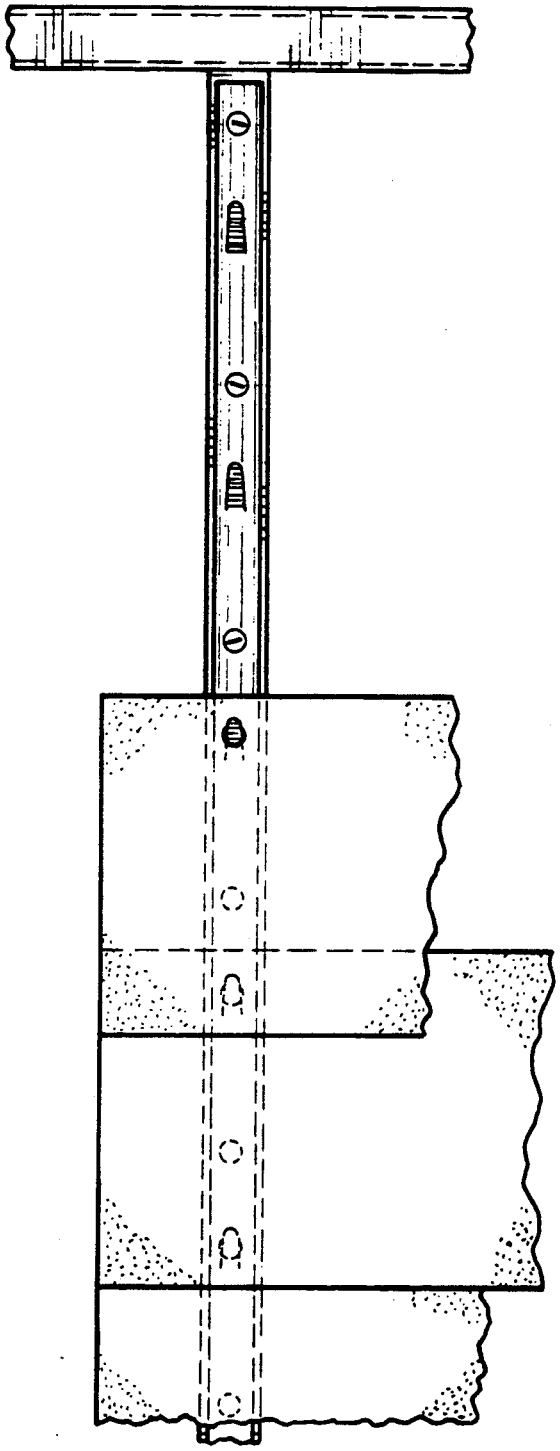
FIG. 7 is a partial front plan view of the storage system illustrated in FIG. 6 illustrating the connection of a panel support to a ceiling support member.

FIG. 5 is yet another embodiment of the invention illustrating a vertically disposed storage system 210 housing a plurality of samples, in this instance, carpet samples 212. FIGS. 6 and 7 are additional views of the vertically disposed storage system 210. The carpet samples are attached to hooks 214. A storage panel 216 is attached to a ceiling support member 218. All of the storage panels described herein, in association with any of the illustrated embodiments, are slideably mounted on their respective ceiling support means. The bottom portions of said storage panels do not make contact with the floor or ground.

Figure 2:
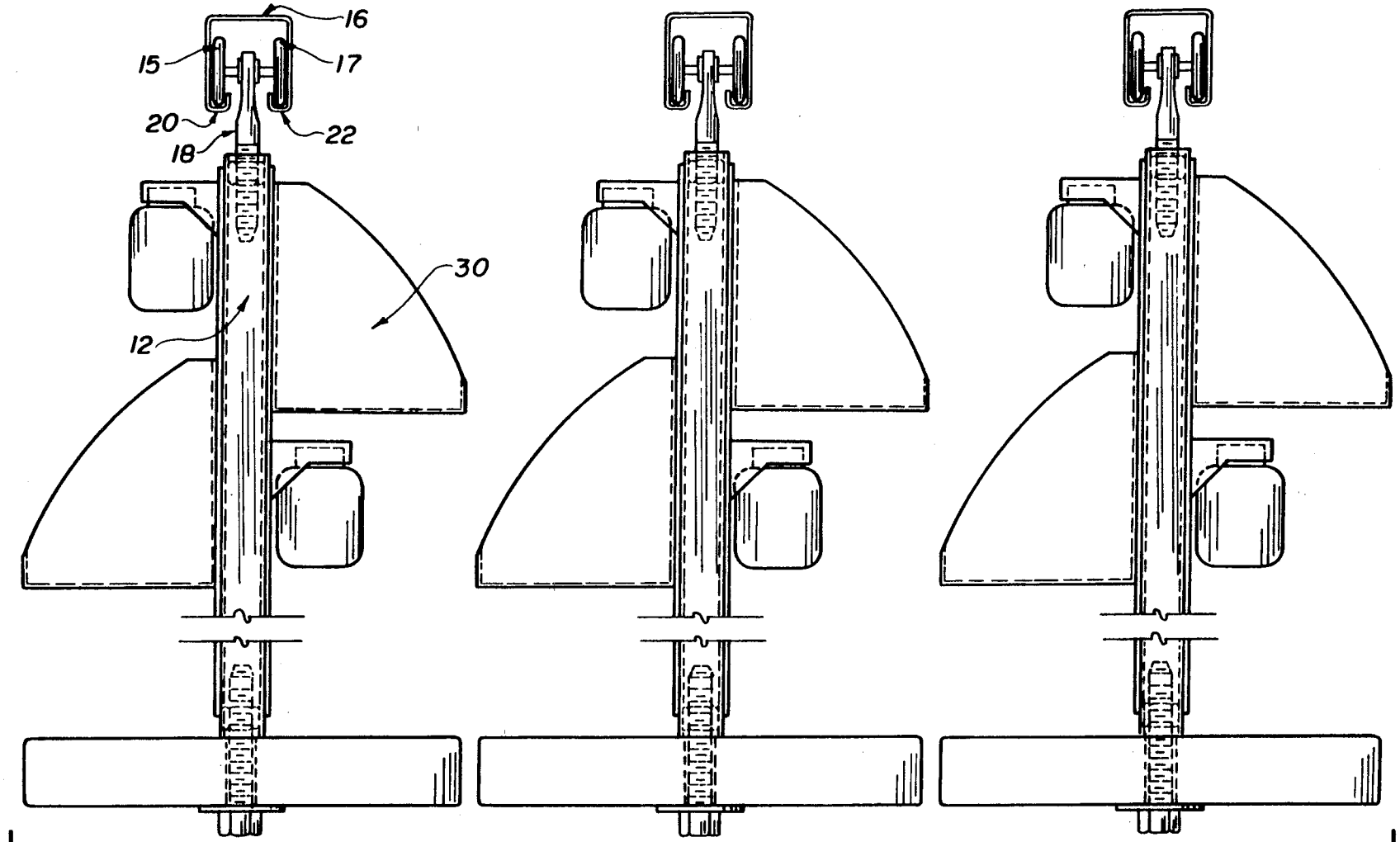
FIG. 2 is a side plan view of three storage panels in side-by-side relationship with respect to each other.

Referring to FIG. 2 which illustrates the panel mounting roller bearing means 15 and 17 housed within a ceiling support member 16, it can be seen that the panels are free swinging in a direction generally perpendicular to said ceiling support member 16 thus facilitating the ease with which one can retrieve an item stored on said panel members. In the event that it is desired to have a storage panel to have greater free swinging capabilities, one could simply attach a bearing member on the hanging member 18 such that the bearing member rotates in a direction perpendicular to ceiling support member 16, 116 and 216 which have been defined earlier in this specification to be track brackets.

The storage system described herein may be expanded as needed, limited only by the size of the storage room. It is virtually maintenance free and relatively inexpensive to construct, requiring no special tools to install. Further, it requires no guide means at the bottoms of the storage modules 12.

The invention may be embodied in other specific forms without departing from the spirit thereof. The preferred embodiment is therefore to be considered in all respects as illustrative and not restrictive, the scope of the invention being indicated by the appended claims, rather than by the foregoing specification.

What is claimed is:

1. A vertically mounted storage system, for retaining selected stored objects and requiring no floor support means, for supporting a predetermined number of vertical slideable mounted generally rectangular storage members comprising:

a plurality of support members, said support members being connected to an elevated surface, a plurality of elongated channel members affixed to said support members, said elongated channel members being generally perpendicular to said support members, said elongated channel members each provided with a pair of parallel tracks for rotatably receiving a plurality of wheeled bearing means, said channel members each having first and second terminating ends, said first and second terminating ends provided with a stop member thereby containing said wheels bearing members within the limits defined by said stop members, a plurality of generally rectangular storage members provided with means for the storing of selected stored objects thereon, said storage members each affixed to a pair of said wheeled bearing members, and wherein at least two storage members are movably held by one of said elongated channel members within the limits defined by said stop members, each of said storage members provided with handle means and capable of being selectively withdrawn such that when one of said selected storage members is moved in a direction away from the remaining storage members, the user is given access to said selected stored objects, and in which said modular storage system provides an aisleway when in a non-use position, said storage members at an end distal to said elongated channel members being free swinging in a direction generally perpendicular to said elongated channel members thereby facilitating the easy movement of said selected storage members.

* * * * *